United States Patent [19]

White

[11] 4,021,321

[45] May 3, 1977

[54] ELECTROLYTIC PREPARATION OF PHOSPHOROUS ACID FROM ELEMENTAL PHOSPHORUS

[75] Inventor: Donald A. White, Creve Coeur, Mo.

[73] Assignee: Monsanto Company, St. Louis, Mo.

[22] Filed: Dec. 15, 1975

[21] Appl. No.: 640,671

[52] U.S. Cl. ..... 204/103

[51] Int. Cl.[2] ..... C25B 1/22

[58] Field of Search ..... 204/103

[56] References Cited

UNITED STATES PATENTS

| | | | |
|---|---|---|---|
| 3,437,438 | 4/1969 | Carroll | 23/165 |
| 3,437,439 | 4/1969 | Carroll | 23/165 |
| 3,437,440 | 4/1969 | Carroll | 23/165 |
| 3,528,772 | 9/1970 | Whyte et al. | 23/165 |
| 3,532,461 | 10/1970 | Whyte et al. | 23/165 |

OTHER PUBLICATIONS

Inorganic Syntheses, vol. IV, 1953, pp. 55–58, "Phosphorous Acid".

*Primary Examiner*—R. L. Andrews
*Attorney, Agent, or Firm*—Wendell W. Brooks; John D. Upham

[57] ABSTRACT

Elemental phosphorus is oxidized via indirect electrolytic oxidation in an electrolysis medium containing elemental phosphorus, an aqueous solution of hydrogen halide, and a non-aqueous solvent to produce phosphorous acid, $(HO)_2HPO$.

26 Claims, 2 Drawing Figures

ELECTROLYTIC PREPARATION OF PHOSPHOROUS ACID FROM ELEMENTAL PHOSPHORUS

BACKGROUND OF THE INVENTION

This invention relates to an improved process for the indirect electrolytic oxidation of elemental phosphorus to phosphorous acid, $(HO)_2HPO$.

The indirect electrolytic oxidation of elemental phosphorus to phosphorous acid is taught in copending application Case No. C-07-21-0308, simultaneously filed to Michael J. Dolan, which application is assigned to the same assignee as is the present case.

Phosphorous acid is available commercially as 30 percent and 70 percent aqueous solutions. The conventional method of preparation of phosphorous acid comprises hydrolyzing phosphorus trichloride according to the diagrammatically simplified reaction:

$$PCl_3 + 3H_2O \rightarrow (HO)_2HPO + 3HCl \quad (1)$$

and evaporating the excess water and the hydrogen chloride which are formed. However, the methods involving these raw materials suffer from a number of disadvantages, most of which are inherent in the prior art methods.

One of the more obvious and vexing difficulties associated with the known methods of preparation of phosphorous acid is the absence of simple, effective, and efficient means of disposal for the large volume of hydrogen halide produced during the conversion (either hydrolysis or otherwise) of phosphorus trihalide to the desired acid. Means which have been proposed for this purpose are generally expensive and less than satisfactory.

As a result of the difficulties and disadvantages associated with the known methods of preparation, phosphorous acid remains a relatively expensive chemical compound.

It has now been discovered that the difficulties and disadvantages of the prior art methods are overcome by the process of the present invention which represents a substantial improvement in the sense that:

a. the hydrogen halide generated is disposed of in situ in a manner which facilitates it being recycled for continued use, with the result that only a catalytic amount of hydrogen halide is required to be added initially; and b. phosphorous acid is obtained relatively inexpensively with a resulting decrease in the commercial price of this important chemical compound.

A further advantage of the present invention is the ready availability of the essential reactants. The essential reactants are elemental phosphorus, hydrogen halide (which is reusable), water, and electric current. Moreover, the possibility of undesirable side reactions occurring is significantly reduced by conducting the electrolysis in an electrolysis medium containing in addition to elemental phosphorus and an aqueous solution of hydrogen halide, a non-aqueous solvent capable of dissolving the molecular halogen generated during the electrolysis as well as at least sufficient amounts of the elemental phosphorus to permit the oxidative reaction between it and the molecular halogen to proceed at a reasonable rate. As the desired reaction proceeds additional elemental phosphorus dissolves, thereby maintaining a continuous supply of dissolved elemental phosphorus available for reaction so long as some undissolved elemental phosphorus remains.

Various other advantages of this invention will become apparent from the accompanying description and claims.

SUMMARY OF THE INVENTION

Figure 1:
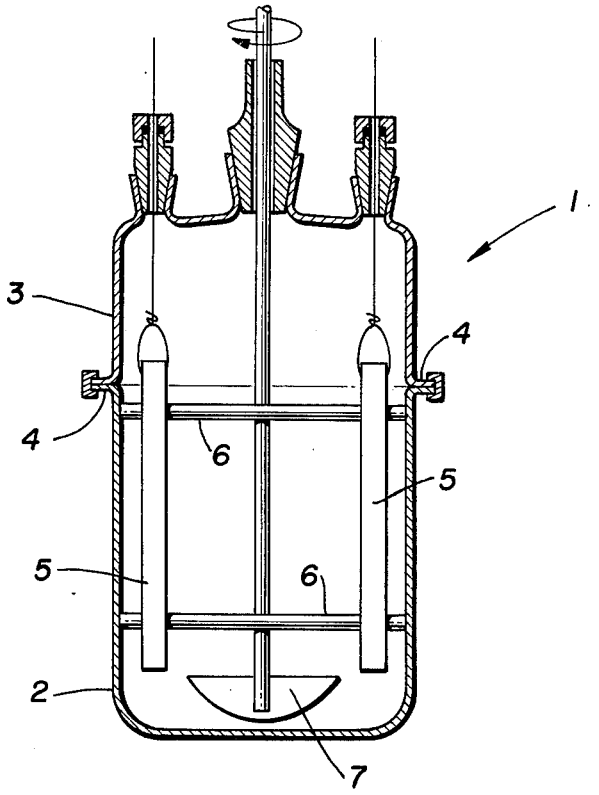
FIG. 1 is a schematic diagram of a cross section of an undivided electrolysis cell suitable for batch operation of the present invention.

According to the present invention, it has been discovered that phosphorous acid can be prepared by the indirect electrolytic oxidation of elemental phosphorous by conducting the electrolysis in an electrolysis medium containing elemental phosphorus, an aqueous solution by hydrogen halide, and a non-aqueous solvent capable of dissolving the molecular halogen generated during the electrolysis as well as at least sufficient amounts of the elemental phosphorus to permit the oxidative reaction between it and the molecular halogen to proceed at a reasonable rate.

DETAILED DESCRIPTION OF THE INVENTION

The improved indirect electrolytic oxidation of elemental phosphorus to phosphorous acid is conveniently represented by reactions (2) through (5).

$$\text{ANODE REACTION } 3X^- \rightarrow 1\tfrac{1}{2}\, X_2 + 3e^- \quad (2)$$

$$\text{SOLUTION REACTIONS } 1\tfrac{1}{2}\, X_2 + \tfrac{1}{4}\, P_4 \rightarrow PX_3 \quad (3)$$

$$PX_3 + 3H_2O \rightarrow (HO)_2HPO + 3H^- + 3X^- \quad (4)$$

$$\text{CATHODE REACTION } 3H^+ + 3e^- \rightarrow 1\tfrac{1}{2}\, H_2 \quad (5)$$

The net effect of reactions (2) through (5) of the present process are summarized as shown in reaction (6).

$$\tfrac{1}{4}P_4 + 3H_2O \rightarrow (HO)_2HPO + 1\tfrac{1}{2}\, H_2 \quad (6)$$

While not desiring to be bound by the theory of the present invention, it is believed that the present process comprises:

a. generation of molecular halogen from the corresponding halide ion by electrolytic oxidation at the anode of an aqueous solution of hydrogen halide;

b. oxidative reaction of the molecular halogen with elemental phosphorus to form phosphorus trihalide; and c. hydrolysis of the thus-formed phosphorus trihalide to produce phosphorous acid and hydrogen halide.

Electrolytic reduction of hydrogen ions (protons) at the cathode completes the electrochemical reaction.

In accordance with the process of the present invention, the indirect electrolytic oxidation reaction is carried out by conducting the electrolysis in an electrolysis medium containing elemental phosphorus, an aqueous solution of hydrogen halide, and a non-aqueous solvent capable of dissolving the molecular halogen generated during the electrolysis as well as at least sufficient amounts of the elemental phosphorus to permit the oxidative reaction between it and the molecular halogen to proceed at a reasonable rate. As the desired reaction proceeds, additional elemental phosphorus dissolves, thereby maintaining a continuous supply of dissolved elemental phosphorus available for reaction so long as some undissolved elemental phosphorus remains.

The non-aqueous solvents which are generally suitable in the practice of the present invention are those which are liquid and inert to elemental phosphorus, molecular halogens, phosphorus trihalides, phosphorous acid, hydrogen halides, and water. By "liquid," it is meant that the solvent is in the liquid state under process temperature conditions.

Typical non-aqueous solvents which are suitable for use in the present invention include the aliphatic solvents of the group consisting of liquid alkanes, halogen substituted alkanes, and sulfur substituted alkanes; and the aromatic solvents from the group consisting of benzene and halogen substituted benzenes. An added advantage of these solvents is that they are capable of dissolving the molecular halogen generated during the electrolysis as well as at least sufficient amounts of the elemental phosphorus to permit the oxidative reaction between it and the molecular halogen to proceed at a reasonable rate.

Illustrative examples of the foregoing solvents include carbon disulfide, chloroform, carbon tetrachloride, 1,1,2-trichloroethane, 1,1,2,2-tetrachloroethane, 1,1,1,2,2-pentachloroethane, ethyl bromide, butyl chloride, butyl bromide, hexane, octane, benzene, o-dichlorobenzene, 1,2,4-trichlorobenzene, and the like. Of these, it is preferred to use those which additionally (a) are substantially water-immiscible; (b) are not inflammable; (c) separate easily from the product solution; (d) have a low dielectric constant; and (e) have a volatility such that losses via evaporation are readily contained.

The term "water-immiscible" as used herein means that the solvent and water will form two separate and distinct phases after being mixed together and then allowed to remain quiescent for periods ranging from a few minutes up to about one hour.

In general it is recognized that so long as all other requirements are met, the greater the number of substituted halogens contained in a compound the more pronounced will be the preferred properties (a) through (e) above. For this reason the halogen substituted alkanes and halogen substituted benzenes which possess such properties, such as, for example, chloroform, 1,1,2,2-tetrachloroethane, 1,2,4-trichlorobenzene, and the like are the nonaqueous solvents of choice. Of these, chloroform is especially preferred since, in addition, reflux of chloroform-water azeotrope maintains a constant reaction temperature (56° C). It is recognized, however, that a less volatile solvent might be required in sustained operations in order to minimize solvent losses.

Elemental phosphorus is a non-metallic element that exists in several allotropic forms (white or yellow, red, and black or violet). All of these forms can be used in the present invention but the white or yellow (the terms are used interchangeably) and red forms are preferred. Of these, the white or yellow form is particularly preferred. The term "elemental phosphorus," as used herein, designates these allotropic forms.

White phosphorus exists as $P_4$, having a tetrahedral molecular structure. It is a brittle, waxy solid which has a melting point of 44.1° C and a boiling point of 280.5° C. Its vapor density corresponds to a formula of $P_4$. It is virtually insoluble in water and alcohol, moderately soluble in chloroform, hexane, and benzene, and is very soluble in carbon disulfide.

The indirect electrolytic oxidation of the present invention is advantageously carried out by conducting the electrolysis in an electrolysis medium containing elemental phosphorus, an aqueous solution of hydrogen halide, and a non-aqueous solvent which is substantially water-immiscible and capable of dissolving the molecular halogen generated during the electrolysis as well as at least sufficient amounts of the elemental phosphorus to permit the oxidative reaction between it and the molecular halogen to proceed at a reasonable rate. As the desired reaction proceeds, additional elemental phosphorus dissolves, thereby maintaining a continuous supply of dissolved elemental phosphorus available for reaction so long as some undissolved elemental phosphorus remains.

The advantages accruing from conducting the electrolysis of the present invention in the electrolysis medium described hereinabove include:

a. the increased efficiency of the reaction between molecular halogen and elemental phosphorus in that the reaction takes place substantially in a single phase, the non-aqueous solvent phase;
b. the hindrance of further oxidation of the phosphorous acid to phosphoric acid in that the phosphorous acid is dissolved in the aqueous phase and the oxidizing agent (molecular halogen) is preferentially dissolved in the non-aqueous phase of the electrolysis medium;
c. increased current efficiency in that cathodic reduction of molecular halogen is minimized by its extraction into the non-aqueous solvent phase; (d) the dispersal of impurities which, in the absence of the non-aqueous solvent, gradually coat the elemental phosphorus and prevent further reaction, particularly at process temperatures in excess of its melting point; and (e) the prevention of the condensation of elemental phosphorus on the cool parts of the electrolysis apparatus by the washing effect of the non-aqueous solvent, particularly at solvent reflux temperatures.

The non-aqueous solvent is employed in amounts sufficient to maintain a preferred volume ratio of the aqueous solution of hydrogen halide to the non-aqueous solvent between about 1:1 and about 5:1. It is to be noted, however, that higher or lower volume ratios can be employed without adversely affecting either the efficiency and course of the reaction or the product distribution so long as sufficient amounts of non-aqueous solvent are present to dissolve the molecular halogen generated during the electrolysis as well as at least sufficient amounts of the elemental phosphorus to permit the oxidative reaction between it and the molecular halogen to proceed at a reasonable rate.

In the practice of the present invention, it is generally desirable to have the electrolysis medium components in a fairly homogenous dispersion, but a true solution is not necessarily required as, for example, elemental phosphorus is only moderately soluble in many of the non-aqueous solvents suitable for use herein and insoluble in water and substantially aqueous solutions. And when a substantially water-immiscible, non-aqueous solvent is employed, it is obvious that it and the aqueous solution of hydrogen halide are substantially mutually insoluble.

It is also desirable in the practice of the present invention to have all of the elemental phosphorus in solution, but in practice it is necessary only to have sufficient amounts dissolved in order to permit the desired oxidative reaction between the elemental phosphorus and the molecular halogen generated during the electrolysis to proceed at a reasonable rate.

When a substantially water-immiscible, non-aqueous solvent is employed it is desirable and, indeed, preferred to have the aqueous phase dispersed relatively uniformly throughout the non-aqueous phase. Such uniform dispersal enables relatively rapid extraction of the molecular halogen produced from the aqueous phase into the non-aqueous phase containing dissolved elemental phosphorus. In addition, the preferred relatively uniform dispersion of the two phases facilitates relatively rapid hydrolysis of the phosphorus trihalide to phosphorous acid, with the concurrent extraction thereof into the aqueous phase. The mixing can be carried out in any conventional manner such as by flow mixers, jet mixers, injectors, turbulence mixers, circulating mixer systems, centrifugal pumps, and the like; by paddle and propeller mixers of various designs as well as by turbine or centrifugal impeller mixers, colloid mills, and homogenizers.

Thus the present invention may use emulsions as well as true solutions. Moreover, in emulsions or media having more than one phase, electrolyses can occur in a solution of the components in one of the phases as, for example, electrolysis of the aqueous solution of hydrogen halide to generate molecular halogen.

The concentration of the aqueous solution of hydrogen halide can vary widely, for example, from about 0.5 percent to about 50 percent or more by weight, but preferred concentrations will often be in the range of about 1.0 percent to about 10 percent by weight, or on a molar basis, often in the range of about 0.1 molar to about 3.0 molar. It is to be noted, however, that the concentration of hydrogen halide has little effect on the current efficiencies and product distribution (although there might be a lower limit which would depend on the current density employed).

Various current densities can be employed in the present process. It will be desirable to employ high current densities in order to achieve high use of electrolysis cell capacity which will result in increased payload. Therefore, for production purposes it will generally be desirable to use as high a density as feasible, taking into consideration sources and cost of electrical current, resistance of the electrolysis medium, heat dissipation, effect upon yields, and the like. Over broad ranges of current density, the density will not greatly affect the yield. And while low densities are operable, suitable ranges for efficient operation will generally be in the range of a few hundred amperes per square meter of anode surface, up to 10,000 or 20,000 or more amperes per square meter.

In effecting the present process, the cell voltage must be sufficient to pass the desired current (amperes) and to effect electrolytic oxidation of hydrogen halide. Generally this value should be as close to the theoretical cell voltage as possible, although it is recognized that the cell voltage will vary with electrode materials and their surface conditions, the distance between the electrodes, various materials in the electrolysis medium, resistance of the electrolysis medium, and resistance of cell dividers, when employed. For example, under the conditions employed in the procedural and illustrative Examples described hereinbelow the cell voltage is between about +4.0 volts and about +8.0 volts.

The present process can be conducted in the various types of electrolysis cells known in the art. In general, such cells comprise a container made of material capable of resisting action of electrolytes, that is, material which is inert under the reaction conditions, for example, glass or plastic and a cathode and an anode, which are electrically connected to sources of electric current. The anode may be of any electrode material so long as it is relatively inert under the reaction conditions. Suitable anode materials include, for example, graphite, de Noratype dimensionally stable anodes, the precious metals such as platinum, palladium, ruthenium, rhodium, and the like, and the precious metals plated onto other metals, such as, for example, titanium and tantalum, although the precious metal type anodes suffer from the disadvantage of being relatively expensive.

The de Nora-type dimensionally stable anodes employ precious metal oxides plated on a titanium substrate. other materials include, for example, ruthenium oxide, mixed with oxides of titanium and tantalum, also plated on a titanium substrate. Dimensionally stable anodes suitable for use in the present process are currently commercially available from the Diamond Shamrock Company, Cleveland, Ohio.

The anode materials of choice, by analogy with the electrolysis of hydrochloric acid in chlorine cells which involves oxidation of chloride ion at the anode and reduction of hydrogen ions at the cathode, are graphite and de Nora-type dimensionally stable anodes. Graphite functions satisfactorily in the present invention except when an aqueous solution of hydrogen chloride is employed as the source of molecular halogen. In such instances the electrolysis causes significant anode corrosion to occur. It, therefore, becomes advantageous to employ the de Nora-type anodes which are sufficiently stable under the reaction conditions utilized so as to eliminate any corrosion problems. A further advantage resulting from the use of dimensionally stable anodes is the lowering of the halogen overvoltage with a concurrent lowering of energy requirements.

Any suitable electrode material may be employed as the cathode so long as it is relatively inert under the reaction conditions and does not promote the production of undesirable side products, such as, for example, phosphine in any significant amount. Graphite serves admirably as a satisfactory cathode material, even when an aqueous solution of hydrogen chloride is employed. It, therefore, is the material of choice. Low hydrogen overvoltage metals, such as, for example, platinum, palladium, and the like are also suitble as cathode material, although they suffer from the disadvantage of being relatively expensive. High hydrogen overvoltage metallic cathodes, such as, for example, mercury, zinc, lead, and the like may be used, but it is advantageous and desirable to avoid their use in that they promote the direct reduction of phosphorus to phosphine.

While a divided cell may be employed in the practice of the present process, an undivided cell is generally preferred. Such a cell offers marked advantages over divided cells for commercial production purposes in that electrical resistance across a cell-divider is eliminated. It is to be noted, however, that when high hydrogen overvoltage metallic cathodes are employed, divided cells may be preferred so as to avoid reduction of phosphorus to phosphine.

The electrolysis cell employed in the procedural Examples herein is primarily for laboratory demonstration purposes. Production cells are usually designed with a view to the economics of the process, and characteristically have large electrode surfaces and short distances between the electrodes.

The electrolysis cell utilized in the procedural and illustrative Examples described hereinbelow is shown in FIG. 1 except for four other necks, one of which is used for addition of reactants and periodic sampling. It is stoppered during the electrolysis. The remaining three of the not-shown necks are used for gas-tight attachment of a water-cooled condenser topped with a mercury-sealed gas outlet and vent, a thermometer, and a gas-inlet tube.

Referring to FIG. 1, electrolysis cell 1 comprises a glass reaction vessel consisting of two sections--bottom section 2 and top section 3--joined together at flange joint 4 and secured by fastening means, such as, for example, metal fastening clamps.

Cell 1 is equipped with graphite electrodes (or de Nora-type dimensionally stable anode and graphite cathode) 5 which are spaced apart a suitble distance by Teflon rods 6. The Teflon rods 6 are extended to the sides of section 2 of cell 1 to maintain the electrode assembly rigid. Cell 1 is also equipped with a mechanical stirrer which is fitted with a large Teflon paddle 7 capable of effecting vigorous agitation of the reaction mixture.

For a general description of various laboratory scale cells see Lund et al, "Practical Problems in Electrolysis," in Organic Electrochemistry (Baizer, ed.), Macel Dekker, New York, 1973, pp. 165–249, and for some considerations of industrial cell designs see Danly, "Industrial Electroorganic Chemistry," in Ibid., pp. 907–946.

The present process is suited to either batch or continuous operations. Continuous operations may involve, after product removal, recirculation of the electrolysis medium, or a component thereof, such as, for example, the aqueous solution of hydrogen halide and/or the non-aqueous solvent in a manner similar to that illustrated in FIG. 2.

Figure 2:
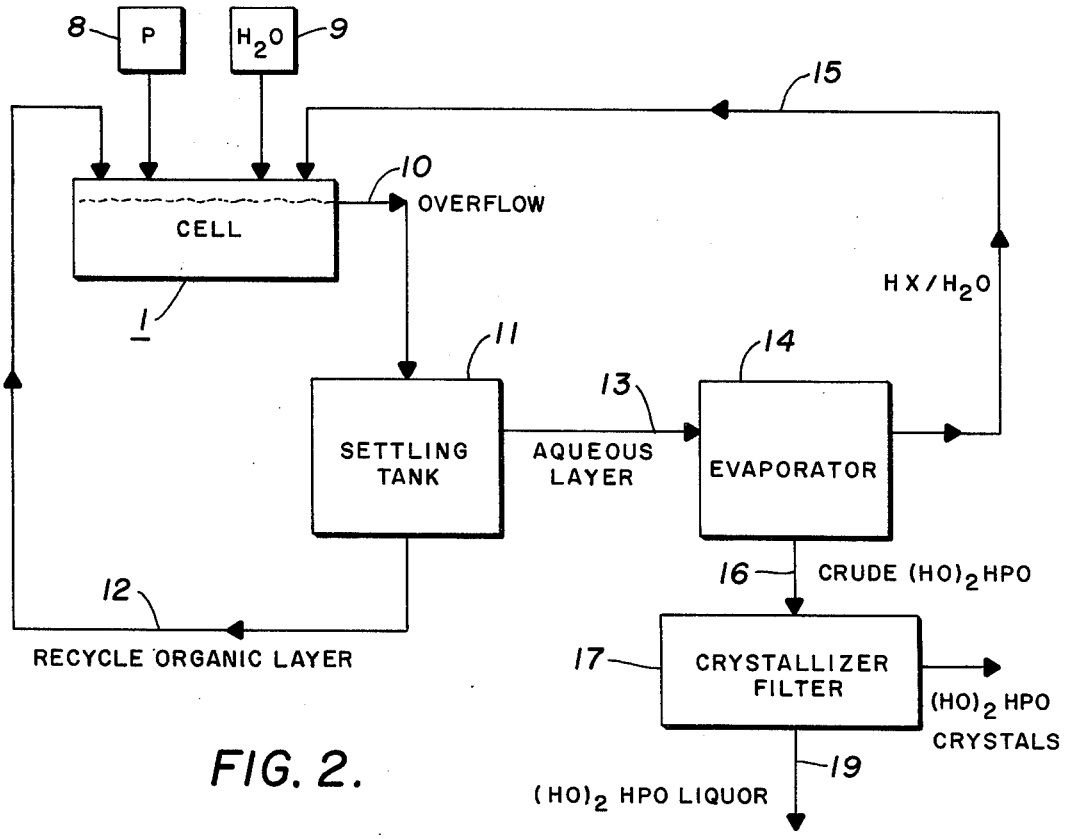
FIG. 2 is a schematic illustration of a typical flow diagram of a process suitable for continuous operation of the present invention.

In order to facilitate the explanation of one such continuous operation as contemplated herein, reference is made to FIG. 2. Electrolysis cell 1 is as shown in FIG. 1 except that it contains additional inlets and outlets sufficient to accommodate any desired additions, withdrawals, and recycling of materials. For example, elemental phosphorus is added from reservoir 8 and water is added from reservoir 9.

The continuous operation procedure as contemplated herein will be explained with reference to the preferred procedure wherein the electrolysis is conducted in the presence of a substantially water-immiscible, non-aqueous solvent. It is to be understood, however, that essentially the same procedure can be employed when any suitable non-aqueous solvent is utilized whether water-miscible or substantially water-immiscible.

As the reaction of the present process proceeds, the reaction mixture containing dissolved phosphorous acid flows by line 10 into settling tank 11 where the aqueous phase and the non-aqueous phase are allowed to separate. The non-aqueous layer is removed and recycled to cell 1 by line 12 for repeated use. The aqueous layer flows by line 13 to evaporator 14 where the water and hydrogen halide (aqueous solution of hydrogen halide) are removed by evaporation and recycled by line 15 to cell 1 for repeated use as a source of molecular halogen. The crude phosphorous acid is discharged by line 16 to crystallizer-filter 17 where it is crystallized and filtered by suction filtration. The crystals are removed and collected through line 18, while the filtrate is discharged through line 19.

A number of options, including but not limited to those described hereinbelow, are available for utilizing the filtrate discharged through line 19. It can be (a) recycled to cell 1 to facilitate isolation of additional phosphorous acid on a repeated run through the reaction system; (b) transferred to a cell similar to cell 1, with an aqueous solution of hydrogen halide (non-aqueous solvent is not necessary in this cell, but its use is not to be precluded, since its use may prove to have long-term advantages, for example, minimization of anode corrosion) and exhaustively oxidized to phosphoric acid, which is useful as an article of commerce; (c) exhaustively oxidized to phosphoric acid by any other means known to the art, for example, catalytic oxidation; or (d) separated into its component acids by any suitable means known to the art, for example, counter current extraction as described in Kovacs et al, U.S. Pat. No. 3,769,384.

It is obvious that the countercurrent extraction process as described in Kovacs et al, U.S. Pat. No. 3,769,384 can also be applied to the aqueous layer flowing through line 13 as well as the crude phosphorous acid discharged by line 16.

The electrolysis of the present process can be conducted at a broad range of temperatures--ambient, or higher or lower temperatures--without any significant effect upon the course of the reaction and the yield of the desired phosphorous acid. For example, temperature ranges from about 20° C or lower to about 180° C are satisfactory. If volatile materials are employed, it may be desirable to avoid elevated temperatures so that the volatile component of the electrolysis medium will not escape, and various cooling means can be used for this purpose. The amount of cooling capacity needed for the desired degree of control will depend upon the cell resistance and the electrical current drawn. If desired, cooling can be effected by permitting a component to reflux through a cooling condenser, or by immersing the electrolysis cell in an ice or ice-salt bath. Pressure can be employed to permit electrolysis at higher temperatures with volatile components, but unnecessary employment of pressure is usually undesirable from an economic standpoint. Moreover, it is to be noted that phosphorous acid, on being subjected to excessive heat, undergoes disproportionation to phosphoric acid and phosphine and/or hydrogen as illustrated in reactions (7) and (8).

$$4(HO)_2HPO \xrightarrow{Heat} 3(HO)_3PO + PH_3 \quad (7)$$

$$(HO)_2HPO + H_2O \xrightarrow{Heat} (HO)_3PO + H_2 \quad (8)$$

Therefore, the preferred temperature is any temperature not sufficient to cause substantial disproportionation. More particularly, the preferred temperature is less than 180° C and greater than the melting point of the elemental phosphorus utilized because at temperatures greater than 180° C reactions (7) and (8) occur at a fairly rapid rate and at temperatures greater than the melting point of the elemental phosphorus utilized, any undissolved elemental phosphorus will exist in molten form which facilitates its dispersal throughout the reaction mixture.

The process of the present invention involves an indirect electrolytic oxidation reaction and therefore requires a source of oxidizing agent. Aqueous hydrogen halide which is employed in catalytic amounts admirably serves this purpose. The preferred molar ratio range of elemental phosphorus to hydrogen halide present in the aqueous solution is between about 1:1 and about 20:1, although the molar ratio can be considerably higher or lower as desired.

While it is recognized that any means known to the art, such as, for example, employing (a) a greater or lesser volume of the aqueous solution of hydrogen halide having the same concentration; (b) a greater or lesser molar quantity of elemental phosphorus; or (c) some combination of (a) and (b) can be employed to effect a change in the molar ratio of elemental phosphorus to hydrogen halide, a convenient means of effecting such a change is simply to increase or decrease the concentration of the aqueous solution of hydrogen halide. And as noted hereinbefore, the concentration of hydrogen halide has little effect on the current efficiencies and product distribution.

The hydrogen halides preferred for use in the present process are hydrogen chloride, hydrogen bromide, and hydrogen iodide. Of these, hydrogen bromide and hydrogen iodide are particularly preferred because of (a) the stability of graphite anodes in their aqueous solutions under process conditions; and (b) the high selectivity towards phosphorous acid which is observed when they are employed. It is recognized, however, that in view of its lower cost, hydrogen chloride might be the hydrogen halide of choice.

The term "selectivity" is employed herein to mean the percentage of reacting molecules of elemental phosphorus converted to phosphorous acid.

Without limiting the present invention in any way, it is believed that in accordance therewith, the hydrogen halide is electrolytically oxidized to molecular halogen, which in turn oxidatively reacts with elemental phosphorus to form phosphorus trihalide. The thus-formed phosphorus trihalide is hydrolyzed to the desired phosphorous acid and hydrogen halide. In this case, however, the need for external means for disposing of the hydrogen halide generated thereby is eliminated; it is disposed of in situ by recycling by means of electrolytic oxidation to molecular halogen for reuse as a reactant. That is, the halide ions are electrolytically oxidized to regenerate molecular halogen which further reacts with elemental phosphorus to produce additional phosphorus trihalide. At the same time the hydrogen ions are electrolytically reduced at the cathode to generate hydrogen gas which, being non-polluting, is safely vented into the atmosphere, or, alternatively, is flared to produce gaseous water as the only product. This means of disposing of the hydrogen halide generated during the hydrolysis of phosphorus trihalide to phosphorous acid provides obvious advantages over procedures described in the prior art.

The phosphorous acid produced in the present invention is conveniently recovered in the form of the free acid. However, it is to be understood that the isolation procedures employed in the procedural Examples and discussed herein are primarily for illustrative purposes. Other procedures can be employed, and may be preferred, for commercial purposes.

When the electrolysis is conducted in an electrolysis medium containing the preferred substantially water-immiscible non-aqueous solvent, the isolation procedure can be described in the following manner. Upon completion of the reaction, the aqueous layer is separated in an inert atmosphere and, if desired, analyzed to determine the total yield of phosphorous acid. Utilizing this value and the total amount of elemental phosphorus consumed during the reaction, the percentage yield of phosphorous acid can also be determined. And while any method of phosphorous acid analysis known to the art can be employed, a method suitable for use herein is hydrogen-1 and phosphorus-31 nuclear magnetic resonance spectroscopy which provides a convenient and efficient method of analysis.

The aqueous layer is evaporated in vacuo at moderate temperatures to yield a viscous liquid which upon cooling to ambient temperatures partially crystallizes. More complete and more rapid crystallization can be induced by using sub-ambient temperatures and by the addition of a seed crystal of phosphorous acid to the viscous liquid. Filtration of the crystallized mass with prolonged suction under a stream of nitrogen yields phosphorous acid as white crystals. Dissolution of the crystals in water followed by evaporation and filtration in the manner described hereinabove affords white crystals of phosphorous acid.

The filtrate from the isolation of phosphorous acid can be recycled to electrolysis cell 1 to facilitate isolation of additional phosphorous acid upon repeating the present process. It can also be utilized by employing any of the remaining available options as described hereinabove.

The following examples illustrate the present invention and the manner by which it can be practiced.

EXAMPLE 1

The reaction was carried out in an undivided cell (FIG. 1) comprising a 1-liter glass reaction vessel consisting of two sections—a bottom section and a top section—joined together at the flange joint and secured by fastening means, such as, for example, metal fastening clamps. The top section had seven necks, with standard-taper inner joints, used for gastight attachment of a mechanical stirrer, two platinum wire electrode connections, a thermometer, a water-cooled condenser topped with a mercury sealed gas outlet and vent, and a gas inlet tube. The remaining neck was used for addition of reactants and was stoppered during the electrolysis. The bottom section had a usable volume up to the flange joint of about 800 milliliters. The cell was equipped with graphite-plate electrodes measuring 10 × 6 × 1.2 centimeters and spaced 3 centimeters apart by Teflon rods which were extended to the sides of the glass reaction vessel to maintain the electrode assembly rigid. Vigorous agitation of the reaction mixture was accomplished by a mechanical stirrer fitted with a large Teflon paddle.

A mixture of white phosphorus (102.0 grams, 3.29 moles), aqueous hydrogen bromide (400 milliliters, 2.4 percent, 0.176 mole; prepared from 20 milliliters of 48 percent aqueous hydrogen bromide and 380 milliliters of water), and chloroform (200 milliliters) was placed in the nitrogen purged cell and heated to about 50° C under a steady stream of nitrogen. The mixture was vigorously agitated to insure good contact between the now molten white phosphorus and the non-aqueous (chloroform) and aqueous layers. Only a portion of the white phosphorus dissolved initially in the chloroform. The vigorously agitated reaction mixture was thereafter electrolyzed under a steady stream of nitrogen with a constant current of 10 amperes for 25.5 hours (which is equivalent to 255 ampere-hours which equal 9.5 Faradays which equal 2.9 Faradays per mole of white phosphorus). The initial cell voltage of 5.5 volts gradually decreased to 4.5 volts. The passage of current maintained the reaction mixture at reflux (chloroform/water azeotrope--56° C). Upon completion of the reaction, the cell and its contents were allowed to cool to ambient temperatures. In a nitrogen atmosphere the aqueous layer was separated and analyzed by hydrogen-1 and phosphorus-31 nuclear magnetic resonance spectroscopy which showed the presence of phosphorous acid (1.99 moles) and a mixture of hypophosphoric and phosphoric acids (equivalent to 0.56 mole of phosphorus). Unchanged phosphorus (0.65 mole) in the chloroform layer and around the sides of the cell was determined by exhaustive indirect electrooxidation to phosphoric acid which was analyzed by phosphorus-31 nuclear magnetic resonance spectroscopy.

Evaporation of the aqueous layer in vacuo at moderate temperatures of between about 70° C and about 80° C yielded a viscous liquid which was seeded with a crystal of phosphorous acid. The crystallized mass was filtered with prolonged suction under a stream of nitrogen to yield white crystals (111.0 grams containing phosphorous acid (96 percent of phosphorus present) and hypophosphoric and phosphoric acids (4 pecent of phosporus present). Dissolution of the crystals in water followed by evaporation and filtration in the manner described hereinabove afforded white crystals of phosphorous acid (100.0 grams) in which no phosphorus-containing impurities were detected by phosphorus-31 nuclear magnetic resonance spectroscopy. By hydrogen-1 nuclear magnetic resonance spectroscopy the purity of the crystals was estimated at 97 percent with the major impurity being water and a small amount (0.2 percent) of hydrogen bromide. This corresponds to a yield of 1.18 mole of pure phosphorous acid.

The current efficiency for the combined production of phosphorus acids (phosphorous acid, hypophosphoric acid, and phosphoric acid) was 91 percent; the conversion of white phosphorus to phosphorus acids as determined by hydrogen-1 and phosphorus-31 nuclear magnetic resonance spectroscopic analysis was 80 percent; and the percentage yield of phosphorous acid isolated was 45 percent based on the conversion of white phosphorus.

The parameters and results for Example 1 and Examples 2 through 6 using the procedure described in Example 1 above are summarized and tabulated in TABLE 1. Also included in TABLE 1 for comparison purposes are Examples 7 and 8 which were carried out without a non-aqueous solvent.

TABLE 1:

| Indirect Electrooxidation of White Phosphorus (P) | | | | | | | |
|---|---|---|---|---|---|---|---|
| | Starting Materials[a,b] | | | Electrolysis Conditions[b] | | | |
| Example Number | White P (g, moles) | Non-Aqueous Solvent | Acid(conc) | Current (Amperes) | Voltage (volts) | Duration (hours) | Temp (° C) |
| 1 | 102.0; 3.29 | $CHCl_3$ | HBr (2.4%) | 10 | 5.5 to 4 | 25.5 | 56 |
| 2 | 20.0; 0.65 | $CHCl_3$ | HCl (3.7%) | 10 | 4.5 | 5 | 56 |
| 3 | 104.5; 3.37 | $CHCl_3$ | HBr (4.8%) | 10 | 4.5 to 4 | 25 | 56 |
| 4 | 20.5; 0.66 | $CHCl_3$ | HI (5.7%) | 10 | 4.5 | 5 | 56 |
| 5 | 51.2; 1.65 | o-$C_6H_4Cl_2$ | HBr (4.8%) | 10 | 4.5 to 4 | 11.5 | 70–80 |
| 6 | 20.0; 0.65 | $C_6H_6$ | HI (5.7%) | 10 | 8 to 6 | 5 | 65 |
| 7 | 100.0; 3.23 | — | HBr (2.4%) | 10 | 8 to 6 | 26 | 70–80 |
| 8 | 40.0; 1.30 | — | HI (5.7%) | 10 | 7 to 6 | 10 | 70–80 |

| Example Number | Analytical Product Distribution[b,c] | | | Quantity $P^3$ [b,e] (moles) | Current Efficiency[f] (%) |
|---|---|---|---|---|---|
| | % P as $P^3$ | % P as $P^4$ | % P as $P^5$ | | |
| 1 | 78[d] | — | 22[d] | 1.99 | 91 |
| 2 | ca64 | n.d. | ca36 | 0.25 | 78 |
| 3 | 80 | 5 | 15 | 1.89 | 84 |
| 4 | 80 | 12 | 8 | 0.39 | 86 |
| | 78[d] | — | 22[d] | | |
| 5 | 77[d] | — | 23[d] | 0.86 | 90 |
| 6 | 75 | 11 | 13 | 0.36 | 85 |
| 7 | 54 | 4 | 42 | 1.02 | 61 |
| 8 | 67 | 5 | 28 | 0.36 | 55 |

[a]Reactions were carried out with solvent (200 ml) + aqueous acid (aqueous solution of hydrogen halide; 400 ml) under $N_2$, unless otherwise indicated.

[b]Abbreviations: $P^3 = (HO)_2HPO$; $P^4 = (HO)_2POPO(OH)_2$; $P^5 = (HO)_3PO$; n.d. = not detected; g = grams; conc = concentration; Temp = Temperature.

[c]Determined by phosphorus-31($P^{31}$) nuclear magnetic resonance (nmr) spectroscopy.

[d]These measurements were made directly on the acidic electrolyte solutions. The $P^5$ figure actually represented $P^4 + P^5$ in these measurements. The remaining measurements were made after making the solutions basic by adding 50 percent aqueous potassium hydroxide.

[e]Determined by hydrogen-1 ($H^1$) nmr spectroscopy.

[f]For the combined production of $P^3 + P^4 + P^5$.

Comparison of the analytical product distribution percentages and the current efficiencies of Examples Number 7 and 8 (conducted without a non-aqueous solvent) with Examples Number 1 through 6, as summarized and tabulated in Table 1, clearly demonstrates the advantages of the present invention. For example, the significantly greater production of undesired hypophosphoric and phosphoric acid in Examples Number 7 and 8 (except for Example Number 2 which employed an aqueous solution of hydrogen chloride) not only reduces the actual yield of the desired phosphorous acid but, in addition, creates added problems of purification.

The current efficiencies of Examples Number 1 through 6 and Examples Number 7 and 8 demonstrates that Examples Number 1 through 6 are significantly more efficient than Examples Number 7 and 8. For example, the average current efficiency for Examples Number 1 through 6 is 86 percent while that of Examples Number 7 and 8 is only 58 percent.

Thus carrying out the indirect electrolytic oxidation of elemental phosphorus to phosphorous acid by conducting the electrolysis in an electrolysis medium containing elemental phosphorus, an aqueous solution of hydrogen halide, and a non-aqueous solvent capable of dissolving the molecular halogen generated during the electrolysis as well as at least sufficient amounts of the elemental phosphorus to permit the oxidative reaction between it and the molecular halogen to proceed at a reasonable rate is demonstrably more efficient and, in addition, produces a greater yield of the desired phosphorous acid.

Phosphorous acid has a number of useful purposes. It is useful as a reducing agent where a strong but relatively slow-acting reducing agent is desirable. It is also useful as a starting material for the production of phosphitic esters such as diethyl phosphite, which is useful as a lubricant additive, antioxidant, and solvent.

Phosphorous acid is also employed as a starting material in the preparation of valuable phosphonate compounds such as ethane-1-hydroxy-1,1-diphosphonic acid which, including water soluble derivatives thereof, are valuable builders for detergent compositions as described in Diehl, U.S. 3,159,581. In addition, phosphorous acid is useful in the preparation of various phosphonomethylamines. Such compounds are known agents for various water treating and similar purposes, particularly as scale inhibiting agents as described in Ralston, U.S. Pat. No. 3,336,221, U.S. Pat. No. 3,234,124. In addition to scale inhibition in boiler waters, and the like, such agents are effective in inhibiting corrosion of iron, steel, and other metals coming into contact with such water under highly oxygenated or otherwise possibly corrosive conditions. And, because of their inhibiting, antiprecipitant, chelating, and sequestering properties, such agents are usefully employed in various soaps, detergents, and cleaning compounds.

While the invention has been described with respect to various specific examples and embodiments thereof, it is to be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. An improved process for the indirect electrolytic oxidation of elemental phosphorus to phosphorous acid which comprises subjecting an electrolysis medium containing elemental phosphorus, an aqueous solution of hydrogen halide, and a nonaqueous solvent to electrolysis, and thereafter recovering phosphorous acid.

2. The process of claim 1 wherein the non-aqueous solvent is liquid, inert, and capable of dissolving the molecular halogen generated during the electrolysis as well as at least sufficient amounts of the elemental phosphorus to permit the oxidative reaction between it and the molecular halogen to proceed at a reasonable rate.

3. The process of claim 2 wherein the non-aqueous solvent is substantially water-immiscible.

4. The process of claim 3 wherein the substantially water-immiscible, non-aqueous solvent is a liquid alkane.

5. The process of claim 4 wherein the liquid alkane is hexane.

6. The process of claim 4 wherein the liquid alkane is octane.

7. The process of claim 3 wherein the substantially water-immiscible, non-aqueous solvent is a halogen-substituted alkane.

8. The process of claim 7 wherein the halogen-substituted alkane is chloroform.

9. The process of claim 7 wherein the halogen-substituted alkane is 1,1,2,2,-tetrachloroethane.

10. The process of claim 3 wherein the substantially water-immiscible, non-aqueous solvent is a sulfur-substituted alkane.

11. The process of claim 10 wherein the sulfur-substituted alkane is carbon disulfide.

12. The process of claim 3 wherein the substantially water-immiscible, non-aqueous solvent is benzene.

13. The process of claim 3 wherein the substantially water-immiscible, non-aqueous solvent is a halogen-substituted benzene.

14. The process of claim 13 wherein the halogen-substituted benzene is o-dichlorobenzene.

15. The process of claim 13 wherein the halogen-substituted benzene is 1,2,4-trichlorobenzene.

16. The process of claim 1 wherein a. molecular halogen is generated from the corresponding halide ion by electrolytic oxidation at the anode of an aqueous solution of hydrogen halide;

b. said molecular halogen oxidatively reacts with the elemental phosphorus to form phosphorus trihalide;

c. said phosphorus trihalide is hydrolyzed to produce phosphorous acid and hydrogen halide;

d. said hydrogen halide is recycled; and d. said phosphorous acid is recovered.

17. The process of claim 16 wherein the phosphorus trihalide is phosphorus trichloride.

18. The process of claim 16 wherein the phosphorus trihalide is phosphorus tribromide.

19. The process of claim 16 wherein the phosphorus trihalide is phosphorus triiodide.

20. The process of claim 16 wherein the hydrogen halide generated during the hydrolysis of phosphorus trihalide to phosphorous acid is disposed of in situ by recycling by means of electrolytic oxidation to molecular halogen for reuse as a reactant.

21. The process of claim 1 wherein the molar ratio of elemental phosphorus to hydrogen halide present in the aqueous solution is between about 1:1 and about 20:1, the volume ratio of the aqueous solution of hydrogen halide to the non-aqueous solvent is between about 1:1 and 5:1; and the process temperature is between about 45° and about 150° C.

22. The process of claim 1 wherein a graphite anode and a graphite cathode are used.

23. The process of claim 1 wherein a de Nora-type dimensionally stable anode and a graphite cathode are used.

24. The process of claim 1 wherein the cell voltage is sufficient to pass the desired current and to effect electrolytic oxidation of hydrogen halide.

25. The process of claim 24 wherein the cell voltage is between about +4.0 volts and about +8.0 volts.

26. The process of claim 1 wherein the elemental phosphorus is white phosphorus.

* * * * *